US005245774A

United States Patent [19]

Huber

[11] Patent Number: 5,245,774

[45] Date of Patent: Sep. 21, 1993

[54] TENSIONING SYSTEM FOR FLEXIBLE SIGN ASSEMBLY

[75] Inventor: Mortimer J. Huber, St. Paul, Minn.

[73] Assignee: Quality Manufacturing Incorporated, St. Paul, Minn.

[21] Appl. No.: 730,636

[22] Filed: Jul. 16, 1991

[51] Int. Cl.[5] ..... G09F 17/00

[52] U.S. Cl. ..... 40/603; 160/378

[58] Field of Search ..... 40/603, 604, 574; 38/102.91; 160/372, 378

[56] References Cited

U.S. PATENT DOCUMENTS

| | | | |
|---|---|---|---|
| 2,335,361 | 11/1942 | Schiller | 160/395 |
| 2,708,529 | 5/1955 | Lander et al. | 220/9 |
| 2,832,171 | 4/1958 | Batey | 38/102.91 |
| 3,529,653 | 9/1970 | Fey, Jr. | 160/378 X |
| 4,317,302 | 3/1982 | Von De Linde | 40/549 |
| 4,380,880 | 4/1983 | Gandy | 40/564 |
| 4,409,749 | 10/1983 | Hamu | 160/378·X |
| 4,452,000 | 6/1984 | Gandy | 40/574 |
| 4,539,734 | 9/1985 | Messerschmitt | 24/460 |
| 4,542,605 | 9/1985 | Gandy | 40/574 |
| 4,554,754 | 11/1985 | Stilling | 40/603 |
| 4,674,214 | 6/1987 | Gandy | 40/603 |
| 4,692,847 | 9/1987 | Gandy | 362/152 |
| 4,802,296 | 2/1989 | Kovalak | 40/607 |
| 4,817,317 | 4/1989 | Kovalak | 40/603 |
| 4,862,615 | 9/1989 | Hillstrom | 40/603 |
| 4,937,961 | 7/1990 | Gandy et al. | 40/603 |
| 4,955,928 | 9/1990 | Tanner | 40/603 |

*Primary Examiner*—Kenneth J. Dorner

*Assistant Examiner*—J. Bonifanti

*Attorney, Agent, or Firm*—Merchant, Gould, Smith, Edell, Welter & Schmidt

[57] ABSTRACT

The present invention provides a flexible sign assembly that includes a frame having a front edge which defines a sign area. A flexible sign material, having a front side and a back side, has a sign body that approximately spans the sign area, and a sign periphery that is releasably secured to the frame. The sign periphery is wrapped around the perimeter of a retaining member with the front side of the flexible sign material contacting the retaining member. An L-shaped extension of a tensioning member is configured to engage a U-shaped channel on the retaining member, thereby capturing a part of the sign periphery therebetween. The tensioning member has a catch that mates with each of a series of ridges on the frame, which ridges are substantially parallel to the front edge of the frame. The engagement between the catch and the ridges is such that the tensioning member is free to move rearward subject to resistance from any tension in the flexible sign material, but the tensioning member is prevented from moving frontward in response to any tension in the flexible sign material. By squeezing an external flange on the frame and an outwardly extending flange on the tensioning member, the tensioning member can be forced into engagement with successively rearward ridges, in order to increase the tension in the flexible sign material. An optional cover member may be secured to the frame to cover and protect the tensioning member and the retaining member.

4 Claims, 3 Drawing Sheets

TENSIONING SYSTEM FOR FLEXIBLE SIGN ASSEMBLY

FIELD OF THE INVENTION

This invention relates generally to flexible sign assemblies, and more particularly, to an improved tensioning system for flexible sign assemblies.

BACKGROUND OF THE INVENTION

Flexible sign assemblies are desirable for several reasons, including relatively low cost and relatively easy transportation and installation. Typically, such flexible sign assemblies include the flexible sign itself, a frame to support the flexible sign, and a "tensioning system" for securing the flexible sign to the frame. The tensioning system has been the focus of previous patents, including U.S. Pat. No. 4,955,928 to Tanner.

The device disclosed in Tanner has a frame with a tensioning edge over which a flexible sign membrane is tensioned. The sign membrane is wrapped around a mounting bar, which in turn, is snapped into a series of small connector components. Each of the connector components includes a plurality of sawtooth ridges that interengage with mating sawtooth ridges on the frame. The interengaging ridges allow movement of the connector components in a first direction to tighten the sign membrane, but prevent movement of the connector components in a second direction in order to maintain tension in the sign membrane. A notch is formed in the frame beyond the mating sawtooth ridges in the first direction to provide means for using a compressing tool to tension the sign membrane.

One problem with the device disclosed in Tanner is that a substantial portion of the sign membrane is wrapped around each mounting bar, making it difficult to make finite tension adjustments. Also, the fact that a series of connector components are snapped onto each mounting bar further complicates the installation process. If a relatively minor adjustment is required, it is necessary to remove all of the connector components by unsnapping them from the mounting bar. Additionally, the long mounting bars limit applications of the Tanner device to sign configurations that are regularly shaped with relatively long and straight edges. Yet another disadvantage of the Tanner device is that a special compressing tool is required in order to significantly tension the sign membrane. The present invention provides a reliable, easy to use tensioning system that overcomes the shortcomings of other available devices, such as that disclosed in Tanner.

SUMMARY OF THE INVENTION

The present invention provides a flexible sign assembly that includes a frame having a front edge which defines a sign area. A flexible sign material, having a front side and a back side, has a sign body that approximately spans the sign area, and a sign periphery that is releasably secured to the frame. The sign periphery is integrally joined to the sign body and passes over the front edge of the frame. A portion of the back side of the flexible sign material contacts the front edge of the frame. The front side of the sign body faces away from the front edge of the frame and defines a frontward direction, and the opposite side or back side of the sign body defines a rearward direction. The present invention further includes a retaining means for releasably securing the sign periphery to the frame, and a tensioning means for tensioning the flexible sign material over the sign area and relative to the frame.

In a preferred embodiment, the tensioning means includes a tensioning member having a catch that mates with each of a series of ridges on the frame, which ridges are substantially parallel to the front edge of the frame. The engagement between the catch and the ridges is such that the tensioning member is free to move rearward subject to resistance from any tension in the flexible sign material, but the tensioning member is prevented from moving frontward in response to any tension in the flexible sign material. By squeezing an external flange on the frame and an outwardly extending flange on the tensioning member, the tensioning member can be forced into engagement with successively rearward ridges, in order to increase the tension in the flexible sign material.

In a preferred embodiment, the retaining means includes a retaining member having a first leg and a second leg, which legs define a U-shaped channel therebetween. The sign periphery is wrapped around the perimeter of the retaining member with the front side of the flexible sign material contacting the retaining member. An L-shaped extension on the tensioning member is configured to engage the U-shaped channel and mate with the retaining member, capturing a part of the sign periphery therebetween. Once the flexible sign material is satisfactorily tensioned and retained, an optional cover member may be secured at the external flange on the frame and the front edge of the frame to cover and protect the tensioning means and retaining means.

The present invention facilitates the installation and adjustment of flexible signs in an efficient and practical manner. These and other advantages of the present invention will become apparent upon a more detailed description of a preferred embodiment.

DETAILED DESCRIPTION OF A PREFERRED EMBODIMENT

Figure 1:
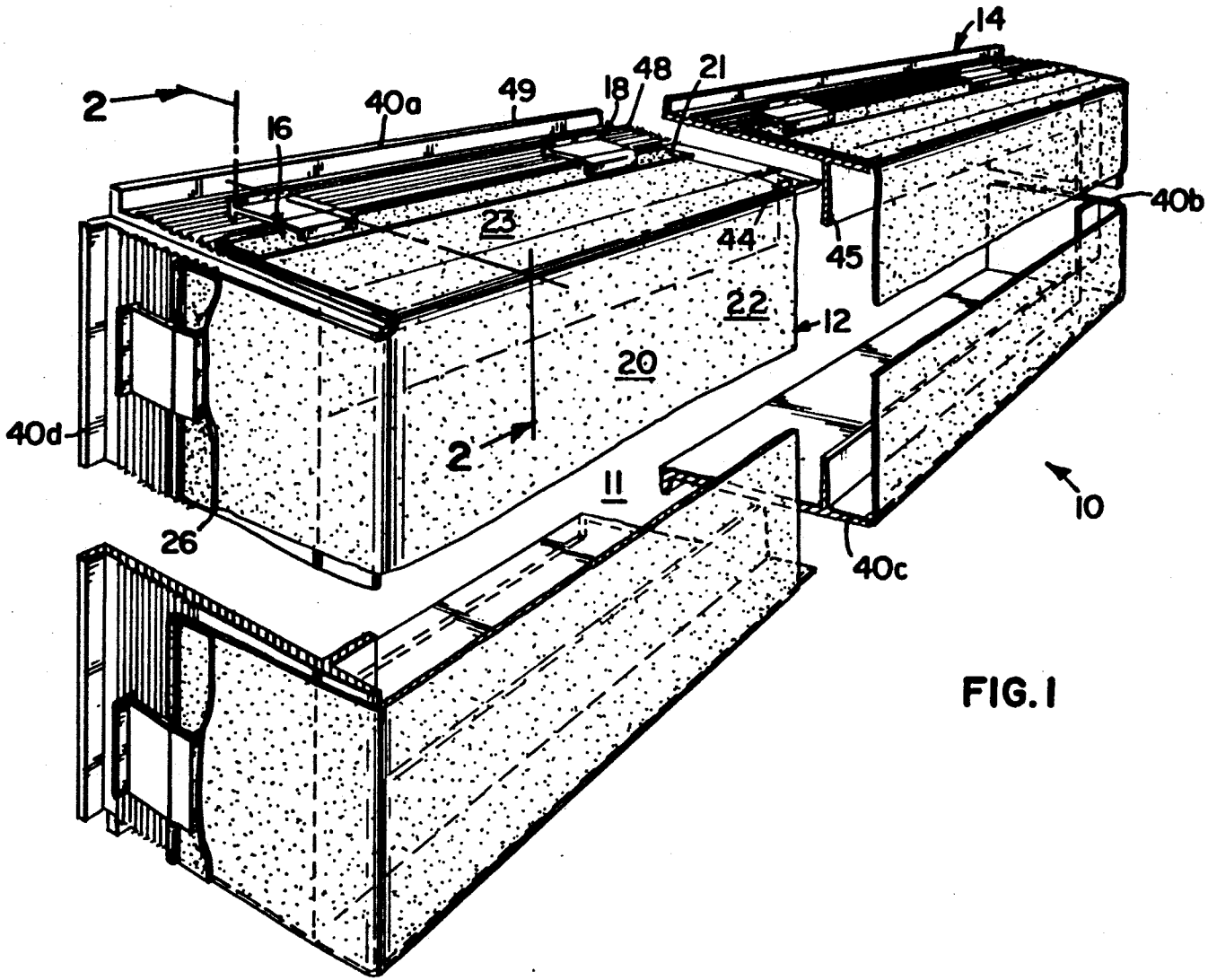
FIG. 1 is a perspective view of a flexible sign assembly configured according to the principles of the present invention.

Referring to the Drawing, wherein like numerals represent like parts throughout the several Figures, a preferred embodiment of a flexible sign assembly configured according to the principles of the present invention is designated generally at 10. The flexible sign assembly 10 generally comprises a sign area 11, a flexible sign material 12, a frame 14, a retaining means 16 for retaining the flexible sign material 12, and a tensioning means 18 for tensioning the flexible sign material 12 across the sign area 11 defined by the frame 14. Although the present invention is described with reference to the rectangular sign assembly 10 shown in FIG. 1, those skilled in the art will recognize that the present invention is not limited to rectangular sign assemblies, and further, that the present invention is particularly well suited for use with irregularly shaped frames and sign assemblies.

The flexible sign material 12, which has a front side 20 and a rear side 21, includes a sign body 22, a sign periphery 23, and a remote sign end 26. The sign body 22 typically bears some sort of message and/or design (not shown) on the front side 20 (facing frontward), and the sign periphery 23 is secured relative to the retaining means 16. The frame 14 includes frame members 40*a*–40*d*, which are secured relative to one another by any of several means (not shown) known in the art, including welding and/or bolting. Those skilled in the art will also recognize that the sign assembly 10 may include structure in addition to internal flange 45 for supporting the structure of the sign assembly 10 (depending on the overall size and configuration of the sign assembly) and for mounting the sign assembly 10 onto other structures, such as a pole or a side of a building (also not shown).

Figures 2, 3:
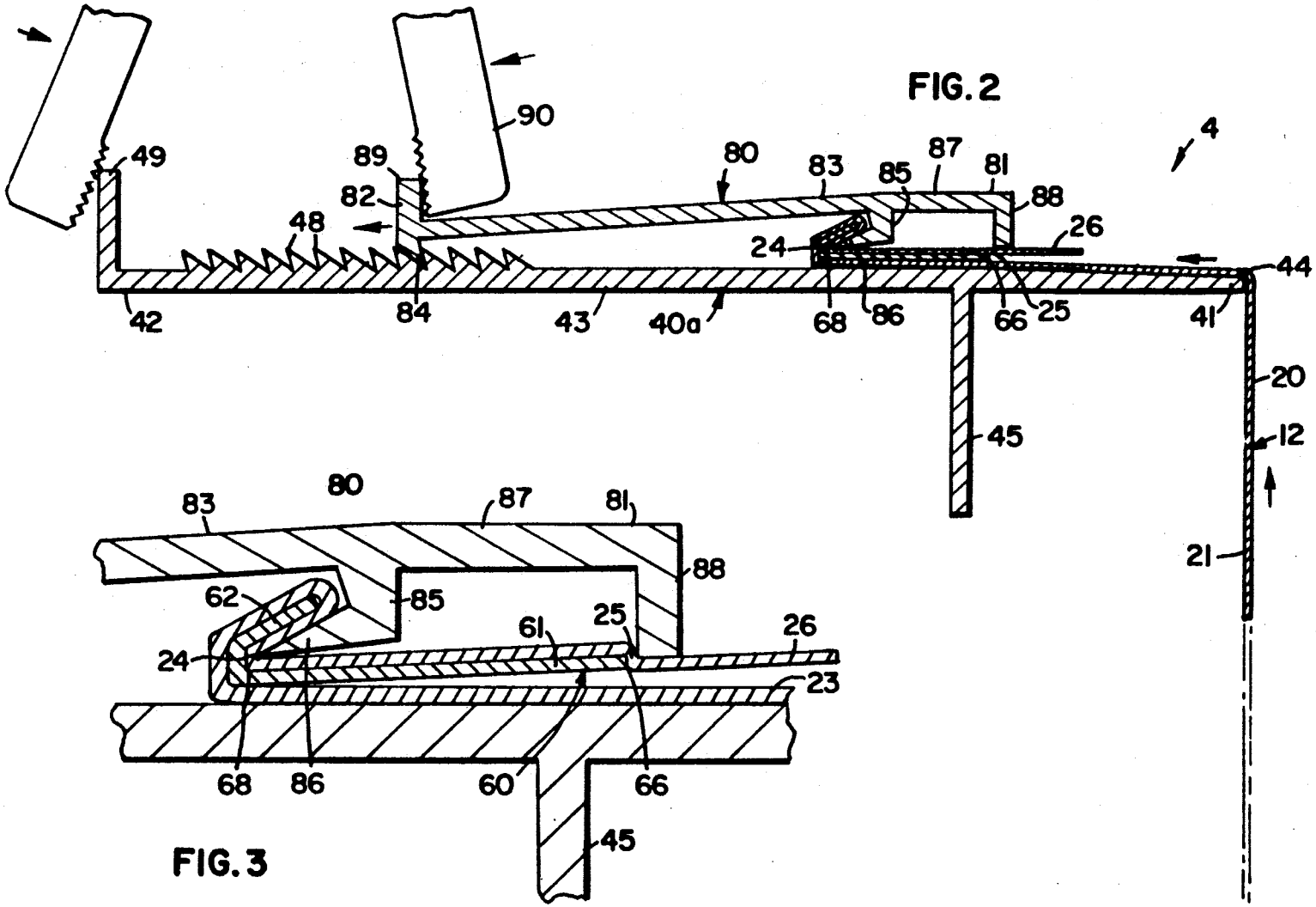
FIG. 2 a sectional view of the flexible sign assembly shown in FIG. 1, including a retaining member and a tensioning member.
FIG. 3 is an enlarged side view of the retaining member and adjacent structure shown in FIG. 2.

Referring to FIG. 2, the frame member 40*a*, which is representative of the other frame members 40*b*–40*d*, is shown in greater detail. The frame member 40*a* includes a first end 41 that functions as a front edge of the sign assembly 10 and defines the sign area 11. In the preferred embodiment shown, the cross-section of frame body 43 of the frame member 40*a* is substantially flat, extending from the front edge 41 to the second end or rear edge 42. The sign periphery 23 passes over the front edge 41, and the back side 21 lies against a sign contact surface 44 proximate the front edge 41. In the preferred embodiment shown, the sign contact surface 44 is approximately perpendicular to the sign body 22, but this angle may vary for different embodiments.

The internal flange 45 extends approximately perpendicularly from the frame body 43, opposite a portion of the sign contact surface 44, and thus, is substantially parallel to the sign body 22. A series of parallel ridges 48 are positioned rearward of the sign contact surface 44 on the same side of the frame body 43. The ridges 48, which extend the length of the frame members 40*a*–40*d*, are parallel to the front edge 41 and are angled in the rearward direction. An external flange 49 extends perpendicularly from the frame body 43 at the rear end 42 and in the opposite direction of the internal flange 45.

Referring to FIG. 3, the retaining means 16 includes a retaining member 60, having a first leg 61 and a second leg 62, which legs define a U-shaped channel 68 therebetween. The sign periphery 23 is simply wrapped all the way around the perimeter of the retaining member 60, with the front side 20 of the flexible sign material 12 contacting the retaining member 60. The retaining means 16 further includes a tensioning member 80, and particularly an L-shaped member 85 on the tensioning member 80, which L-shaped member 85 is configured to engage the U-shaped channel 68 and thereby mate with the retaining member 60, capturing a portion 24 of the sign periphery 23 therebetween. A tip 86 on the L-shaped member 85 "pinches" the portion 24 relative to the channel 68.

In a preferred embodiment the tensioning member 80 also includes an extension 87 supporting an inwardly extending flange 88. In an operative configuration, the inwardly extending flange 88 is approximately perpendicular to the frame member body 43 and the retaining member 60. Where the wrapped sign periphery extends beyond a frontward end 66 of the retaining member 60, the inwardly extending flange 88 cooperates with the end 66 to "pinch" a second portion 25 of the sign periphery 23 therebetween.

The tensioning member 80 further includes a tensioning member body 83 that is substantially flat and extends from a first end 81 having the inwardly extending flange 88, to a second, rearward end 82 having an outwardly extending flange 89. In an operative configuration, the outwardly extending flange 89 is approximately perpendicular to the frame member body 43 and thus, is substantially parallel to the external flange 49 on the frame member body 43. In a preferred embodiment there is a slight angle between the tensioning member body 83 and the extension 87. The L-shaped member extends approximately perpendicularly from the juncture of the tensioning member body 83 and the extension 87. In an operative configuration, the L-shaped member, as well as the inwardly extending flange 88, extend toward the frame member 40 on which the tensioning member 80 rests. Also, the tip 86 of the L-shaped member 85 extends rearward to engage the frontwardly facing U-shaped channel 68 of the retaining member 60. Additionally, the outwardly extending flange 89, which extends away from the frame member 40 on which the tensioning member 80 rests, and the external flange 49 on the frame 40 oppose one another and are designed to be squeezed relative to one another by pliers 90 or a similar tool in order to increase sign tension, as is further explained below.

The tensioning member 80 further includes a catch 84 extending perpendicularly from the tensioning member 80 and opposite the outwardly extending flange 89. Those skilled in the art will recognize that the relative positions of the catch 84 and the outwardly extending flange 89 are not paramount to the feasibility of the present invention. The catch 84 is designed to mate with the ridges 48 in such a manner as to prevent relative forward movement of the catch 84, but allow relative rearward movement of the catch 84. Thus, with the sign periphery secured by the retaining means 16, the flexible sign material may be tensioned by "squeezing" the outwardly extending flange 89 toward the external flange 49 to move the catch 84 to successively rearward ridges 48.

Referring back to FIG. 1, once the flexible sign material 12 has been roughly positioned relative to the frame 14, it is a relatively simple matter to begin securing portions of the sign periphery 23 to the frame 14. In the preferred embodiment, the frame members 40*a*–40*d* are simply extruded profiles, so that the external flange 49, the ridges 48, and the front edge 41 extend all the way around the perimeter of the frame 14. Accordingly, the retaining members 60 and tensioning members 80 may be spaced along the frame members at any desired intervals. Further, with the capability to readily release and "recapture" a portion of the sign periphery 23, it is a relatively easy matter to remove wrinkles by making lateral adjustments of the retaining members 60 and the tensioning members 80 relative to the frame members 40*a*–40*d*.

The installation process is further facilitated where the sign material 12 is sufficiently large to have a remote sign end 26 extending beyond the pinched portion 25. By grabbing the remote sign end 26 and tugging in the appropriate direction prior to "tensioning," an individual can single-handedly erect and tension the sign assembly 10. In a preferred mode of installation, the process should begin near the middle of one of the frame members and proceed outward from there. Markings (not shown) may be imprinted at the center of each frame member and the center of each corresponding sign periphery, in order to facilitate location of these desired positions. Alternatively, it may be desirable to begin at a corner of the frame and proceed around the frame from there. In any event, the desired tension is achieved by simply squeezing the external flange 49 and the outwardly extending flange 89 with the pliers 90.

Figure 4:
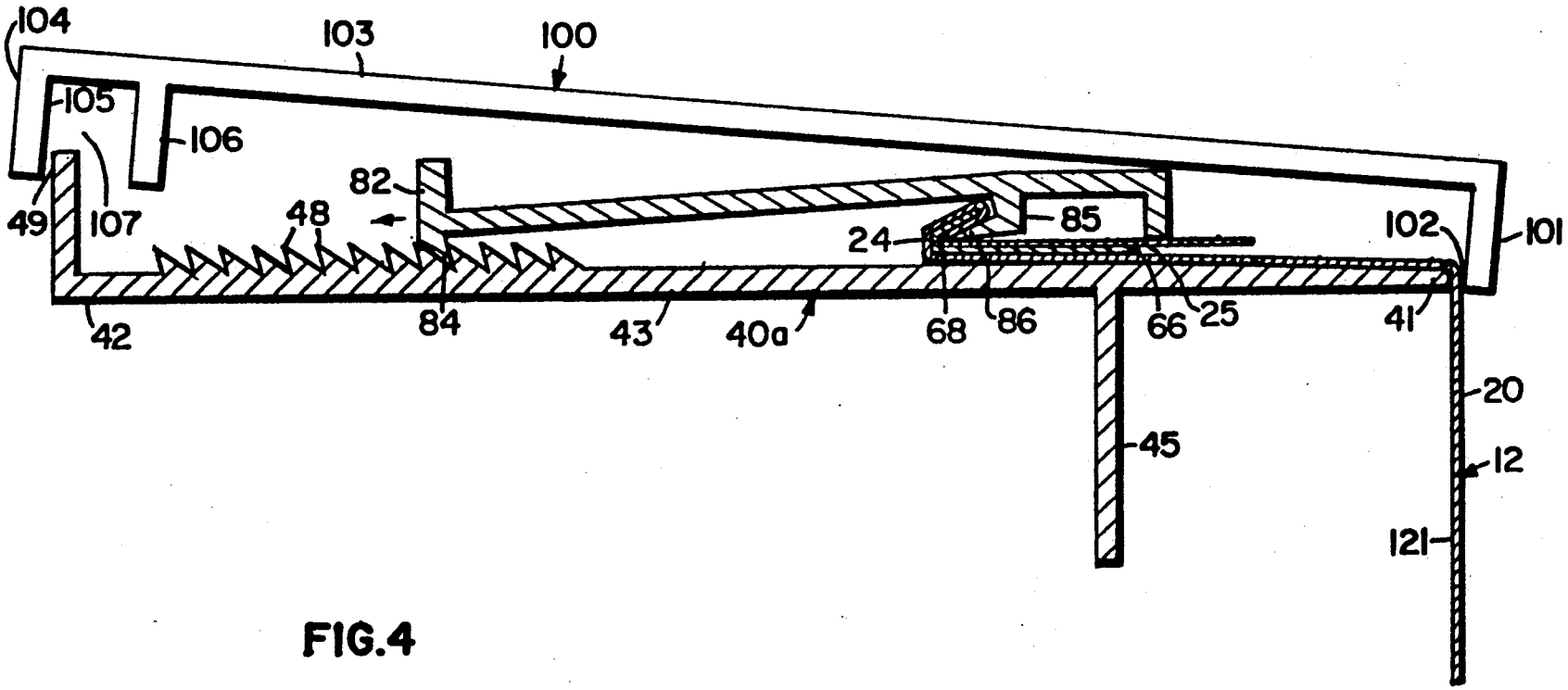
FIG. 4 is an enlarged side view of the retaining member and adjacent structure shown in FIG. 3 with a cover member secured over the tensioning member and the retaining member.

Referring to FIG. 4, once the flexible sign material 12 is satisfactorily tensioned and retained, cover means may be secured to the frame to cover and protect the tensioning means and retaining means. The cover member 100 includes a cover body 103 extending between a first flanged end 101 and a second flanged end 104. An intermediate flanged member 106 extends from the cover body 103 proximate the second flanged end 104, defining a groove 107 therebetween. The cover member 100 is configured such that a first internal contact surface 102 on the first flanged end 101 engages the front edge 41 of the frame member 40, pinching the sign material 12 therebetween, while a second internal contact surface 105 engages the external flange 49 of the frame member 40. Tension in the cover member 100 and friction between the internal contact surfaces 102 and 105 and the corresponding frame components 41 and 49 hold the cover member 100 in place. Additional cover member mounting means (not shown) may include friction enhancing materials on the internal contact surfaces and the corresponding frame components and/or catches, such as inwardly facing lip members at the free ends of the flanged ends. The addition of the cover member not only protects the tensioning means and the retaining means, but also provides a more aesthetically pleasing sign assembly.

While a specific embodiment of the invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. A flexible sign assembly, comprising:

(a) a frame having a front edge that defines a sign area;

(b) a flexible sign material having a front side and a back side, wherein said flexible sign material includes (i) a sign body that approximately spans said sign area and (ii) a sign periphery, integrally joined to said sign body, that passes over said front edge and is releasably secured relative to said frame, wherein a portion of said back side of said flexible sign material contacts said front edge, and said front side of said sign body faces away from said front edge and defines a frontward direction, and said back side defines a rearward direction;

(c) a retaining means, operatively connected to said frame and said flexible sign material, for releasably securing said sign periphery to said frame; and (d) a tensioning means, operatively connecting said retaining means to said frame, for tensioning said flexible sign material over said sign area and relative to said frame, wherein said tensioning means includes:(i) a series of ridges on said frame, wherein said ridges are substantially parallel to said front edge of said frame; (ii) a tensioning member having a catch that mates with each of said ridges in such a manner that said tensioning member is free to move rearward subject to resistance from any tension in said flexible sign material, but said tensioning member is prevented from moving frontward in response to any tension in said flexible sign material; (iii) an external flange on said frame; (iv) an outwardly extending flange and said external flange are substantially parallel, said external flange and said outwardly extending flange being substantially parallel to said sign body; and (v) operating means for squeezing said outwardly extending flange relative to said external flange, wherein said tensioning member is forced into engagement with successively rearward ridges, whereby said flexible sign material is increasingly tensioned.

2. A flexible sign assembly, comprising:

(a) a frame having a front edge that defines a sign area;

(b) a flexible sign material having a front side and a back side, wherein said flexible sign material includes (i) a signal body that approximately spans said sign area and (ii) a sign periphery, integrally joined to said sign body, that passes over said front edge and is releasably secured relative to said frame, wherein a portion of said back side of said flexible sign material contacts said front edge, and said front side of said sign body faces away from said front edge and defines a frontward direction, and said back side defines a rearward direction;

(c) a retaining means, operatively connected to said flexible sign material, for releasably securing said sign periphery to said frame;

(d) a tensioning means, operatively connecting said retaining means to said frame, for tensioning said flexible sign material over said sign area and relative to said frame, wherein said tensioning means includes:(i) a series of ridges on said frame, wherein said ridges are substantially parallel to said front edge of said frame; (ii) a tensioning member having a catch that mates with each of said ridges in such a manner that said tensioning member is free to move rearward subject to resistance from any tension in said flexible sign material, but said tensioning member is prevented from moving frontward in response to any tension in said flexible sign material; (iii) an external flange on said frame; (iv) an outwardly extending flange and said external flange are substantially parallel; and (v) operating means for squeezing said outwardly extending flange relative to said external flange, wherein said tensioning member is forced into engagement with successively rearward ridges, whereby said flexible sign material is increasingly tensioned; and (e) a cover means, releasably secured relative to said front edge and said external flange on said frame, for covering and protecting said retaining means and said tensioning means, wherein said cover means includes a cover member having a first flanged end that engages said front edge on said frame, and a second flanged end that engages said external flange on said frame.

3. A flexible sign assembly, comprising:

(a) a frame having a front edge that defines a sign area;

(b) a flexible material having a front side and a back side, wherein said flexible sign material includes (i) a sign body that approximately spans said sign area and (ii) a sign periphery, integrally joined to said sign body, that passes over said front edge and is releasably secured relative to said frame, wherein a portion of said back side of said flexible sign material contacts said front edge, and said front side of said sign body faces away from said front edge and defines a frontward direction, and said back side defines a rearward direction;

(c) a tensioning means, operatively connected to said flexible sign material and said frame, for tensioning said flexible sign material over said sign area and relative to said frame;

(d) a retaining means, operatively connecting said retaining means to said flexible sign material, for releasably securing said sign periphery to said tensioning means, wherein said retaining means comprises: (i) a retaining member having a first leg substantially perpendicular to said sign body, and a second leg, which define a channel therebetween, wherein said sign periphery is wrapped around said retaining member with said back side of said flexible sign material contacting said retaining member; and (ii) an L-shaped member operatively connected to said tensioning means, wherein said L-shaped member is configured to engage said channel and mate with said retaining member, capturing a part of said sign periphery therebetween; and (e) an extension, the extension being formed as part of the retaining member, the extension being integrally joined to said L-shaped member and having an inwardly extending flange proximate a front end of said first leg of said retaining member and capturing another part of said sign periphery therebetween.

4. A flexible sign assembly, comprising:

(a) a frame having a front edge that defines a sign area;

(b) a flexible material having a front side and a back side, wherein said flexible sign material includes (i) a sign body that approximately spans said sign area and (ii) a sign periphery, integrally joined to said sign body, that passes over said front edge and is releasably secured relative to said frame, wherein a portion of said back side of said flexible sign material contacts said front edge, and said front side of said sign body faces away from said front edge and defines a frontward direction, and said back side defines a rearward direction;

(c) a tensioning means, operatively connected to said flexible sign material and said frame, for tensioning said flexible sign material over said sign area and relative to said frame;

(d) a retaining means, operatively connecting said tensioning means and said flexible sign material, for releasably securing said sign periphery to said tensioning means, wherein said retaining means includes: (i) a retaining member having a first leg and a second leg, which define a channel therebetween, wherein said sign periphery is wrapped around said retaining member with said back side of said flexible sign material contacting said retaining member; and (ii) an L-shaped member operatively connected to said tensioning means, wherein said L-shaped member is configured to engage said channel and mate with said retaining member, capturing a part of said sign periphery therebetween; and (e) a cover means, releasably secured relative to said front edge and said external flange on said frame, for covering and protecting said retaining means and said tensioning means, wherein said cover means includes a cover member having a first flanged end that engages said front edge on said frame, and a second flanged end that engages said external flange on said frame.

* * * * *